US005730271A

United States Patent [19]

Buchman et al.

[11] Patent Number: 5,730,271

[45] Date of Patent: Mar. 24, 1998

[54] CURRENCY VALIDATOR WITH SECURITY BOX

[75] Inventors: Sergey N. Buchman; Vladimir A. Schwartz, both of Kiev, Ukraine

[73] Assignee: CashCode Company Inc., Concord, Canada

[21] Appl. No.: 502,099

[22] Filed: Jul. 13, 1995

[51] Int. Cl.[6] ..... G07D 7/00

[52] U.S. Cl. ..... 194/206; 232/15; 271/181

[58] Field of Search ..... 194/206, 207, 194/350; 271/178, 180, 181; 232/15, 16

[56] References Cited

U.S. PATENT DOCUMENTS

| | | | |
|---|---|---|---|
| 4,949,901 | 8/1990 | Harris | 232/15 |
| 5,129,330 | 7/1992 | McKay et al. | 232/15 X |
| 5,209,395 | 5/1993 | Zouzoulas et al. | 271/181 X |
| 5,411,249 | 5/1995 | Zouzoulas | 271/181 |
| 5,419,423 | 5/1995 | Ishida et al. | 194/206 |

FOREIGN PATENT DOCUMENTS

| | | |
|---|---|---|
| 39 31 571 | 3/1991 | Germany . |
| 2 236 143 | 5/1995 | United Kingdom . |

*Primary Examiner*—F. J. Bartuska

[57] ABSTRACT

A security box for a bill validator is closed to the contents thereof even when the box is removed from a validator. The box has a lockable lid through which access to the box can only be gained when the lid is opened. The security box is also preferably lockable to the validator.

6 Claims, 8 Drawing Sheets

CURRENCY VALIDATOR WITH SECURITY BOX

FIELD OF THE INVENTION

The present invention is directed to a currency validating device and in particular is related to a currency validator device having an improved security box.

BACKGROUND OF THE INVENTION

There are many examples of currency validators where a bill, token or other substrate is introduced to the currency validator and when a proper validation has been made, the bill is stored in a security box. Such validating devices which receive bills typically have a stacking arrangement associated with the security box to improve the efficiency of storage of the bills.

In most cases, the security box is open on the one side to allow a pusher mechanism associated with the actual validator to push through the opening, forcing a received bill from a guide arrangement at one side of the box to a stored position behind the guide arrangement. With such security boxes, the last bill to enter the box is exposed and basically the stack of bills in the box can be removed through the one side when the security box is released from the validator.

There have been attempts to improve the security of the contents of a security box, particularly when the security box is removed from the validator whereby the contents are not immediately accessible. One such improvement is disclosed in U.S. Pat. No. 5,129,330. In this case, the removal of the stacking box requires a cover member to be inserted into the device, which cover member effectively closes the stacking box on the one side. This is an improvement over the prior art open side stacking boxes, but it is relatively complex and requires the cover to be present at the time of removal of the storage box.

It has also been known to provide a pusher mechanism and a separate electrical drive for the pusher mechanism within a lockable security box. A releasable electrical plug provides power and logic signals for controlling the drive. With this structure, the cost and complexity of each security box is very high.

The present invention improves the security associated with bill stacking arrangements, and in particular uses a closed security box which is releasably engaged by the validating device. In this way, when the security box is removed, it is closed and the currency is not immediately accessible. The security box includes a hinged lid which is lockable such that the person removing the security box does not have immediate access to the contents thereof. There is no need for this user to have that lock, as that lock merely locks the security box. A mechanical pusher arrangement is interior to the security box and has a mechanical power transfer member extending through the box, which when actuated, drives the pusher arrangement. In a preferred embodiment, a separate locking arrangement is provided for locking the security box to the validating device. In this way, the security box can be opened in a secure environment and the person who is removing the security box from the validating device does not have access to the contents of the security box.

SUMMARY OF THE INVENTION

A security box according to the present invention is for use with a currency validator and the box is generally closed and has a narrow opening for receiving a bill of the currency.

The box includes a lockable door movable from a position closing the box to an open position where the interior of the box is accessible to allow removal of any bills accumulated therein. The box includes a guide arrangement interior to the box, which initially receives a bill which passes through the narrow opening and the security box also includes means for accumulating stacked bills in a stacked orientation to one side of the guide arrangement. The means for accumulating includes a mechanical pusher arrangement for forcing a received bill from a position located in said guide arrangement to said stacked orientation to one side of the guide arrangement. The pusher mechanism has an actuate extending through said security box, which when actuated, imparts the desired movement to said pusher mechanism to stack a received bill.

According to yet a further aspect of the invention, the lockable door has a lock thereon such that the box is locked in a closed condition and access to the accumulated bills in the security box is denied without opening of the lock.

According to yet a further aspect of the invention, the lockable door is at an end of the security box and the actuator means is located on a side of the box.

According to yet a further aspect of the invention, the security box includes a spring latch for releasably securing a box in a bill validator.

According to yet a further aspect of the invention, the spring latch includes means for receiving a lock which prevents removal of the security box from a bill validator without removal of the lock.

The present invention is also directed to a currency validator which includes means for receiving bills and if validated, stores the bills in a releasable security box secured to the validator. The security box is closed and includes a narrow slot opening through which a bill enters the security box when validated. The security box is releasably retained in the currency validator by a first lock arrangement preventing unauthorized release of said security box from said validator. The device further includes a second lock arrangement associated with a door access of the security box through which access of the interior of the security box is gained. The second lock arrangement prevents unauthorized access to the security box independent of securement to the validator.

According to an aspect of the invention, the validator is such that the second lock arrangement is not accessible when the security box is secured in the validator.

According to yet a further aspect of the invention, the security box includes interior thereto a guide arrangement for receiving bills which pass through the narrow slot and an actuator for forcing a received bill positioned in the guide arrangement to a bill stacker arrangement to one side of the guide arrangement.

According to yet a further aspect of the invention, the actuator includes a drive transfer structure in a side of the security box and the validator includes a drive member positioned to cooperate with the drive transfer structure and cause the actuator to force a received bill in the guide arrangement into the bill stacker area when the drive member is activated.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
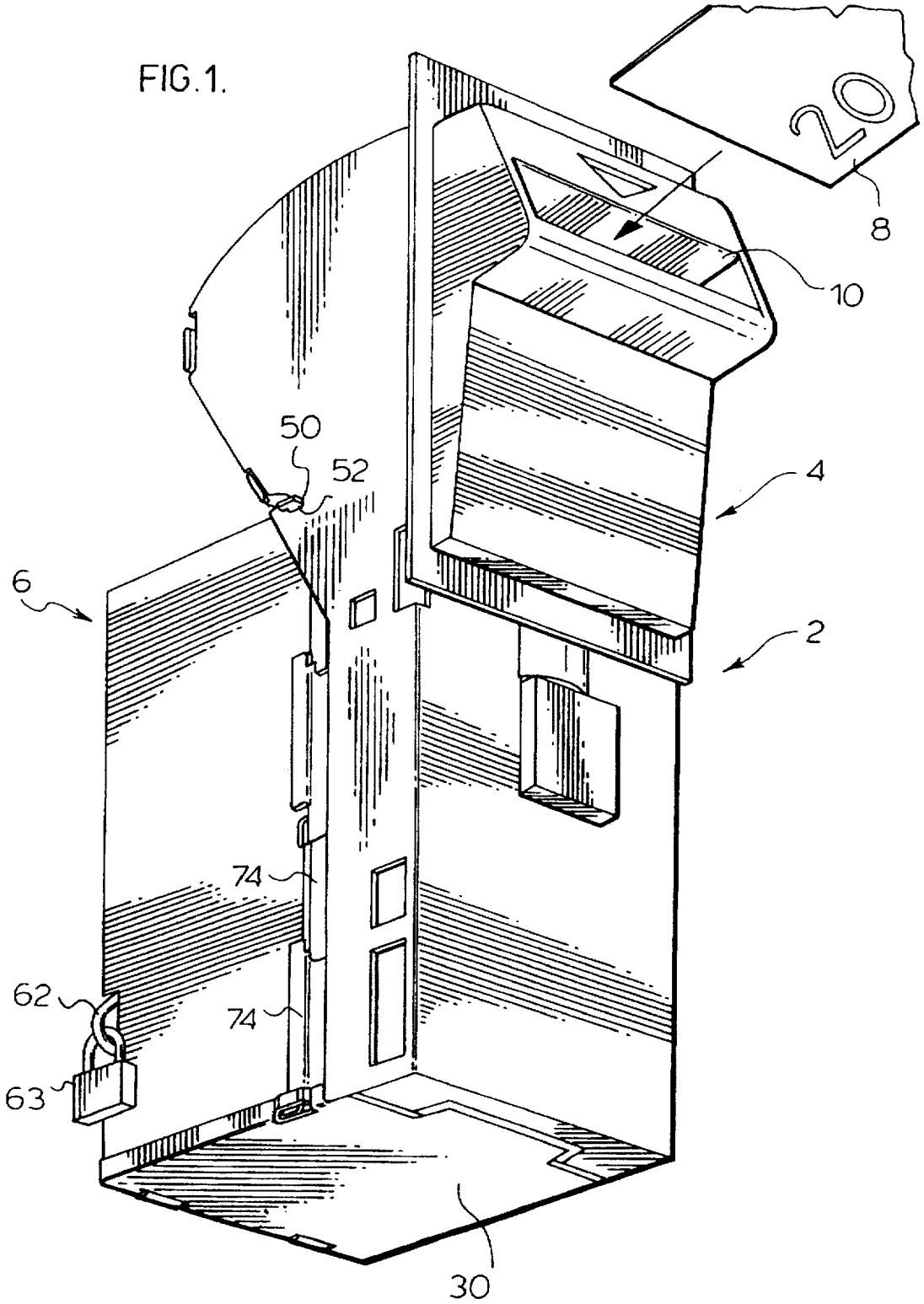
FIG. 1 is a partial perspective view of the bill validating arrangement.

The currency validator 2 includes a processing unit 4 in combination with a releasable security box 6. A bill 8 can be introduced into the validator through the feed slot 10 and the bill passes along the enclosed path, generally shown as 12 in FIG. 4, and if valid, is passed through the inlet 14 of the security box to align with one side of the security box. As shown in FIG. 5, the enclosed path 12 moves the bill 8 past a sensing unit 18 to determine whether the bill is valid. The bill is driven by drive wheels 16 and if the bill is determined to be valid, the drive wheels also force it to be introduced into the security box.

Figure 2:
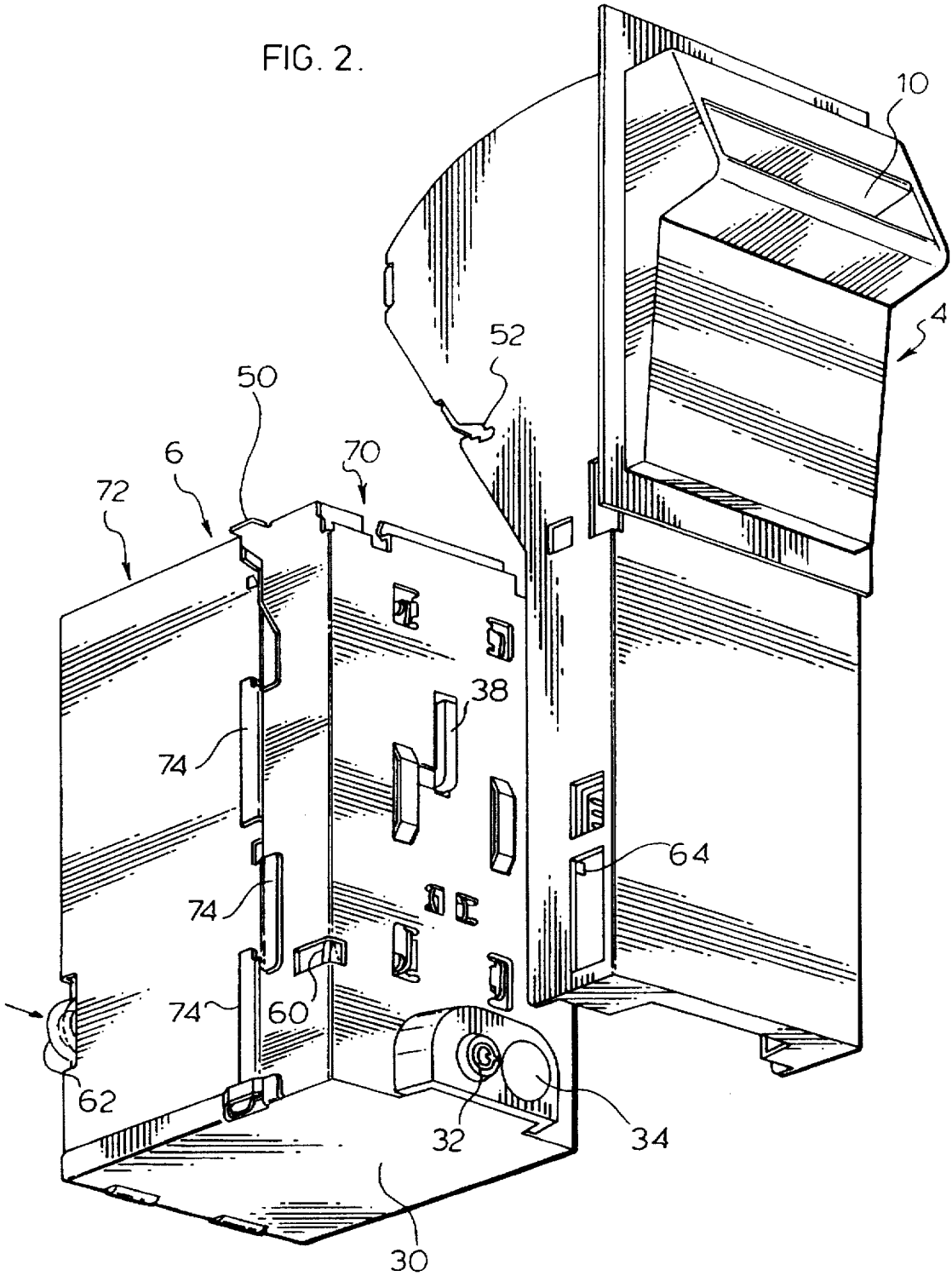
FIG. 2 is a perspective view of the bill validator with the security box released therefrom.

FIG. 2 clearly illustrates the closed security box 6 and how it is releasably mounted to the processing unit 4. In contrast to other bill stacking arrangements, the entire security box is enclosed and includes its own mechanism interior to the security box which communicates with a drive exterior to the security box for forcing a bill into the stacking area.

The inlet 14 includes two opposed inwardly extending flanges 65 and 67 to form a narrow passageway through which a validated bill passes to be received by the guide arrangement 40. This passageway restricts access to the interior of the security box and is preferable to a slot port in the security box. To avoid possible jamming of a bill, a drive wheel 16*a* and idler wheel 17 are located adjacent the inlet 14.

Figure 9:
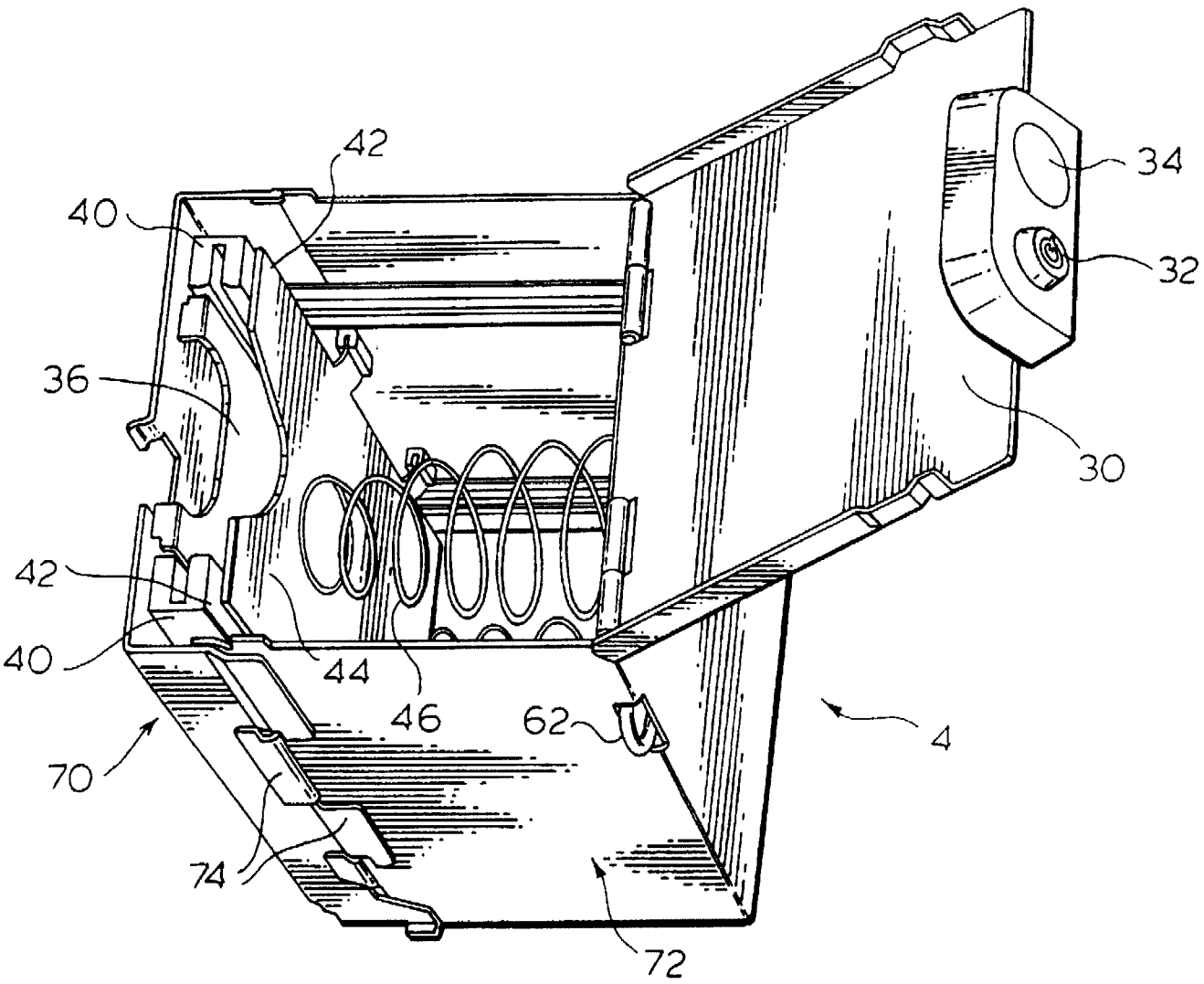
FIG. 9 is a perspective view of the security box with the lid thereof open showing the interior of the box.

FIG. 9 perhaps best illustrates the preferred structure of the security box 4, which includes the releasable hinged lid 30. This hinged lid can be locked by means of lock 32 such that access to the contents of the security box cannot be obtained without release of the lock. It can be seen that the security box includes a first actuator portion 70 which cooperates with the storage portion 72. These components are releasable from one another when the lid is open, but are held together by the overlapping stationary finger members 74. Each security box includes an inlet 14 which introduces the bill 8 into the guide members 40 located to either side of the security box with each guide member having a slot 41 for receiving an edge of a received bill. Once the bill is fully entered into the security box, it can then be moved by pusher mechanism 36 into a stacking arrangement in front of the spring mounted support plate 44. This spring mounted support plate 44 provides a spring bias and serves to keep the bills in a stacked orientation. When the actuator mechanism pushes past the guides, it will force the support plate 44 into the clear area in the security box. The spring 46 pushes the stacked bills back against the keeper faces 42.

Figure 4:
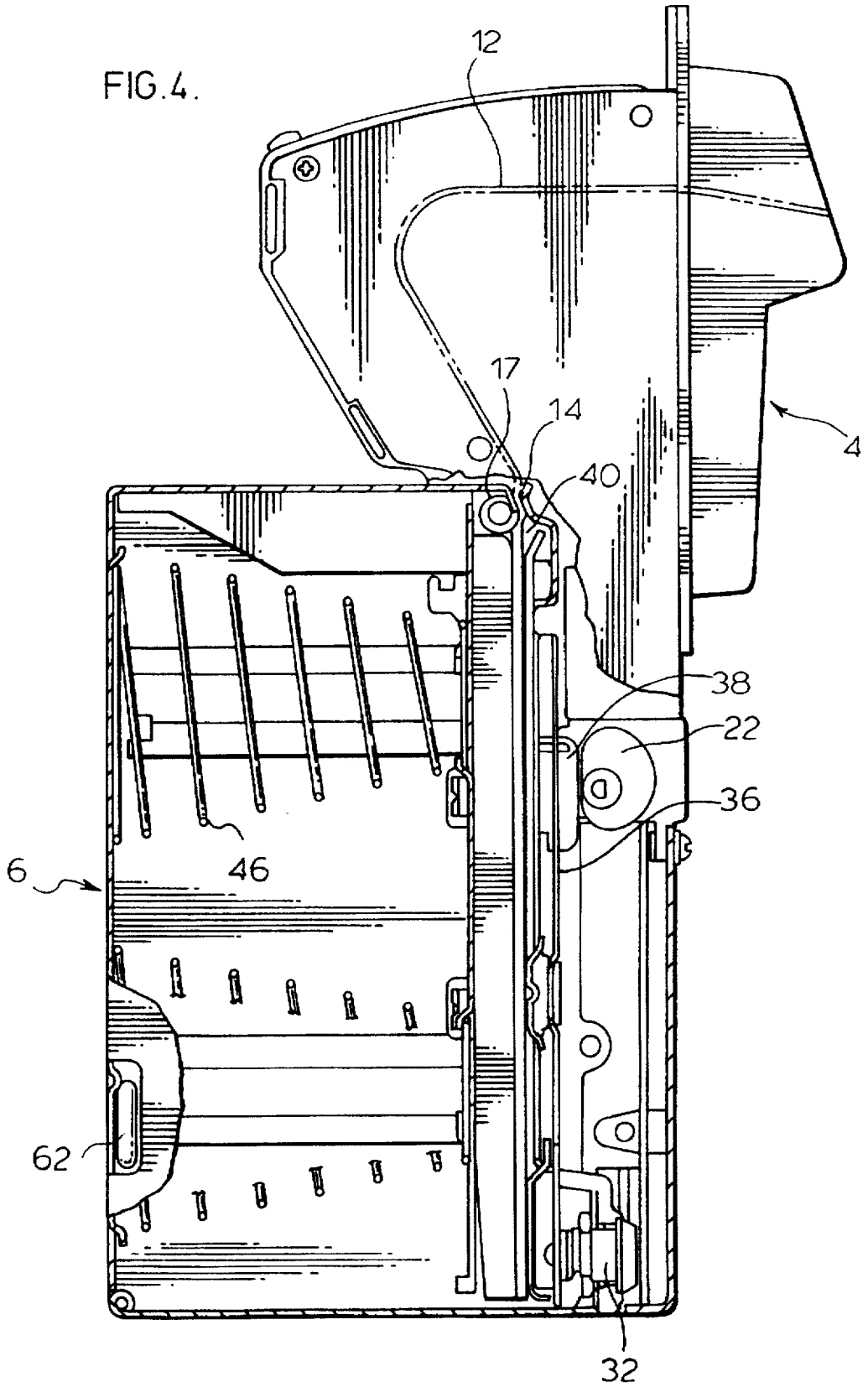
FIG. 4 is a sectional view of the bill validator and security box with details of the interior of the security box being shown.
Figure 5:
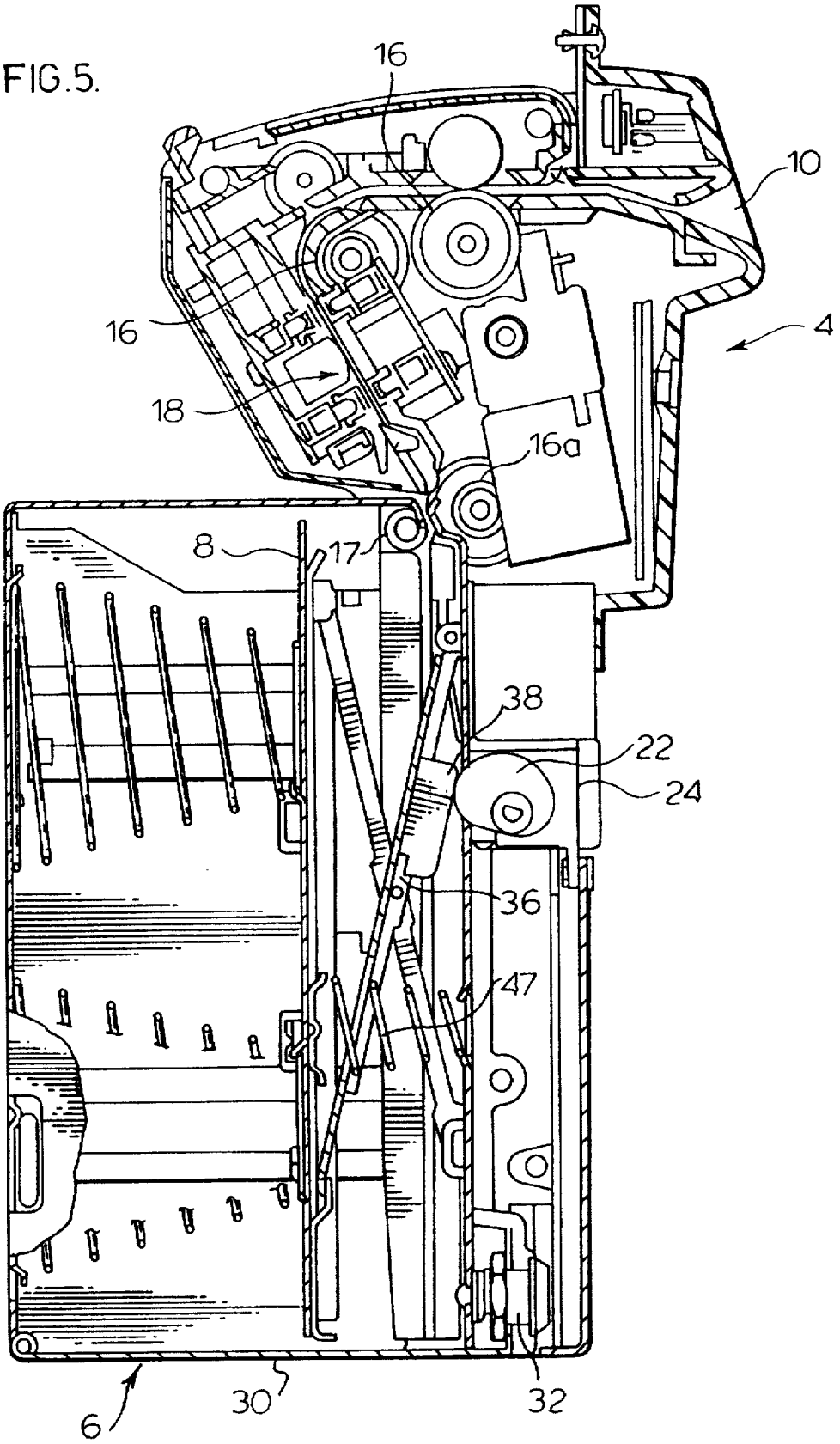
FIG. 5 is a sectional view similar to FIG. 4 showing a bill being forced into the stacking arrangement as well as the additional components of the bill validator being outlined.
Figure 6:
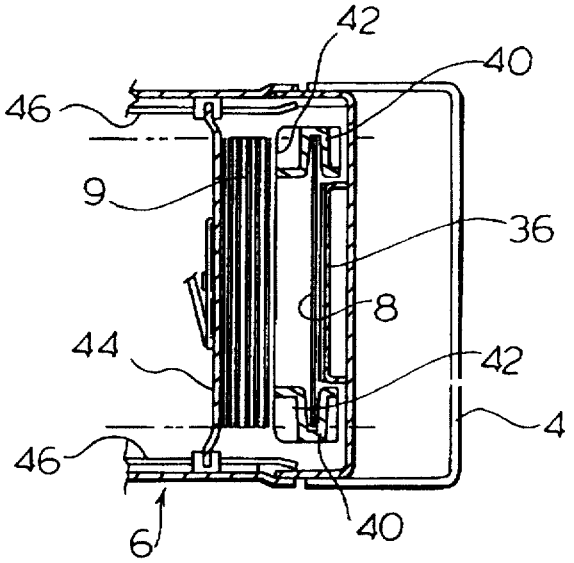
FIGS. 6, 7 and 8 are sectional views through the bill validator showing various positions of the actuating mechanism for forcing a bill into the storage area.
Figure 7:
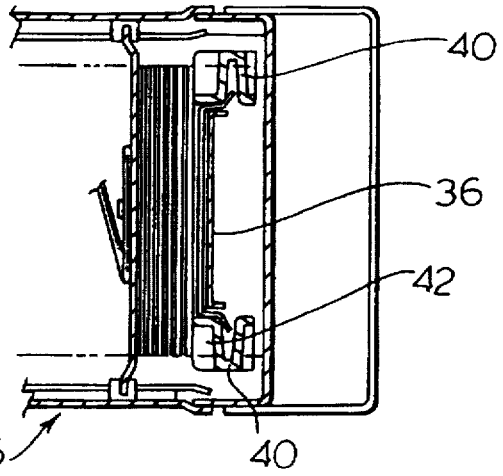
Figure 8:
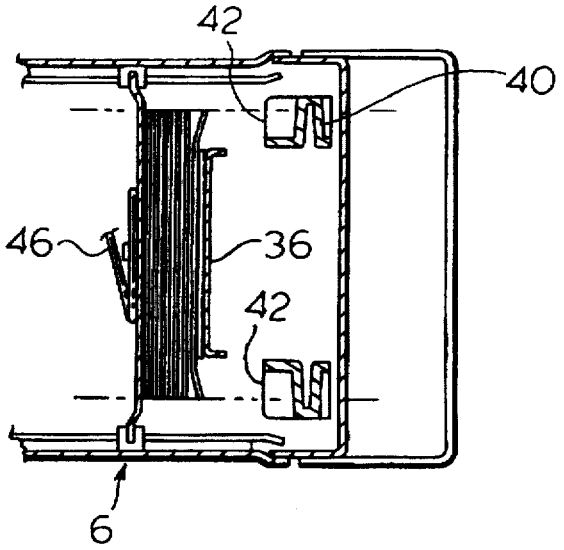

FIG. 4 shows the pusher mechanism 36 in a fully retracted position awaiting receipt of a valid bill. FIG. 5 shows the pusher mechanism 36 after it has moved past the guide members 40 and past the keeper faces 42. Thus, it can be seen that the bill 8 has entered the storage area of the stacker arrangement. Details of this mechanism is shown in FIGS. 6, 7 and 8. The mechanism 36 in FIG. 6 is in the standby state and in FIG. 7 has moved to force the bill 8 partially past the guide members 40. FIG. 8 shows the actuating mechanism in a clear state past the keeper faces 42. The actuating mechanism will subsequently be drawn back to the standby state of FIG. 6. The pusher mechanism is compact and only occupies a limited amount of space at one side of the box, leaving more room for stacking of validated bills.

FIG. 5 shows one arrangement for driving of the pusher mechanism 36. In this case, a cam drive motor 24 rotates drive cam 22. The drive cam 22 contacts the drive plate 38 which is part of the pusher mechanism. The rotary motion of cam 22, when driven from the initial position of FIG. 4 to the fully extended position of FIG. 5, imports the desired movement to the pusher mechanism. Further rotation of the cam from the position of FIG. 5 to the position of FIG. 4 will bring the pusher mechanism back to the position of FIG. 4. It can be seen that there is a tension spring 47 for drawing the pusher mechanism to this state.

The important aspect to be recognized from the above is that the security box includes interior thereto its own guide arrangement 40 for receiving of bills as well as a mechanical actuating mechanism for forcing the bills past the guide members. The drive plate 38 is located in a small port in the security box and effectively closes the port to prevent unauthorized access while still allowing the processing unit 4 to provide the power and timing of the power to impart the desired motion to the actuating mechanism.

Figure 3:
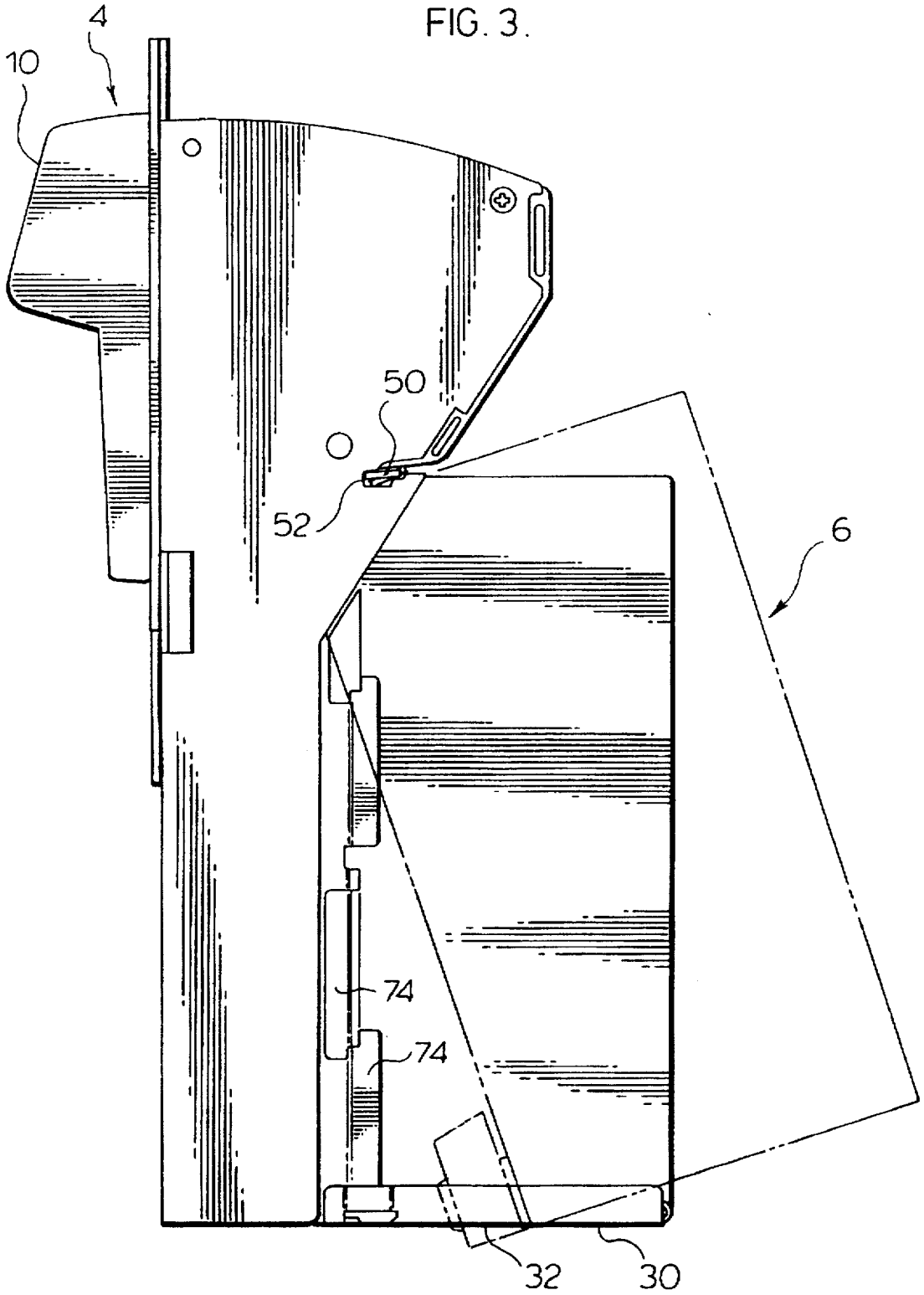
FIG. 3 is a side view of the bill validator showing the security box being secured thereto.

Securement of the security box to the processing unit 4 is shown in FIG. 1 and FIG. 3. In this case, locating tabs 50 cooperate with slot recesses 52 in the sides of the processing unit for positively securing the upper portion of the security box to the processing unit. As the security box is rotated about these tabs to engage the lower portion of the processing unit, spring latch 60 of the security box passes a stationary keeper, generally shown as 64 in FIG. 2, which keeper is not accessible from the exterior of the validator. This keeper is shaped to force the spring latch to move therepast and be captured behind the keeper. In order to remove the security box 6 from the secured position within the processing unit, spring latch actuator 62 is forced into the security box. This causes the spring latch 60 to move to a clear position and allows the box to be swung outwardly and is effectively released from the processing unit. It can be seen that the spring actuator 62 includes a looped portion having a cavity through which a lock 63 can be inserted, as shown in FIG. 1. In this way, a person can remove the security box from the processing unit 4 while the security box continues to be locked by lock 32. The person removing the security box does not have access to the interior of the security box and does not know the exact contents of the security box. In this way, the possibility of theft by unauthorized personnel is reduced. It can also be appreciated that as the personnel does not know the exact contents of the security box, they are less tempted. In many prior art structures, the last bill validated would be exposed and forms a temptation, which is removed with the present structure.

The security box can also include a nonvolatile memory storage member 34 which cooperates with the processing unit 4 for recording of the various bills being validated by the processing unit. In this way, the security box, when opened, can be checked and any discrepancies between the information in memory and the actual bills in the security box is immediately apparent.

A further aspect of the invention can be appreciated from FIGS. 1, 3 and 4 where the hinged lid 30 is at the bottom of the security box and the lock 32 is not accessible as it is being covered by the processing unit 4. In this way, the spring latch 60 serves to form an initial line of defense such that the lock 32 is not immediately accessible.

The loop actuator 62 is located at the rear of the security box away from the processing unit for easy access in removing the security box and to also make access to the padlock 63 convenient. This rear position is generally less confined and there is sufficient room for different sized padlocks. This can be a considerable factor where several validators are placed side by side.

As illustrated in FIG. 4, the present security box preferably includes its own pusher mechanism 36 located interior to the security box. A drive plate 38 or drive cam can be positioned exterior to the box and passed through a port for driving of the mechanism. In this way, the pusher mechanism covers the port and the integrity of the security box is maintained, however, on occasion this pusher mechanism may require maintenance and it has been found desirable to have the actuator portion 70 easily removable from the storage portion 72 of the security box. This accomplished by opening of the lid 32 and thereafter the actuator portion 70 and the storage portion 72 can be separated by a sliding action. In the closed position of the lid, the sliding action is denied. With this structure, service is easily performed on the pusher mechanism and, if necessary, a different actuator portion can be combined with the storage portion 72 while the original actuator portion is being serviced.

Figure 10:
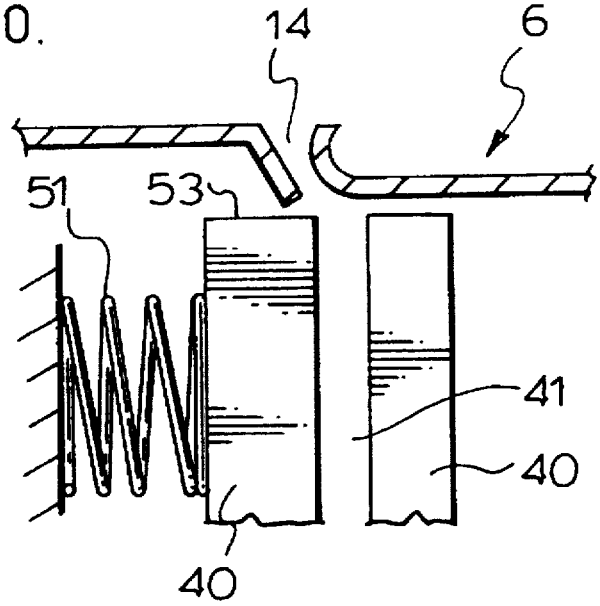
FIGS. 10 and 11 show a preferred aspect where the bill inlet to the security box is restricted when the box is removed from the validator.
Figure 11:
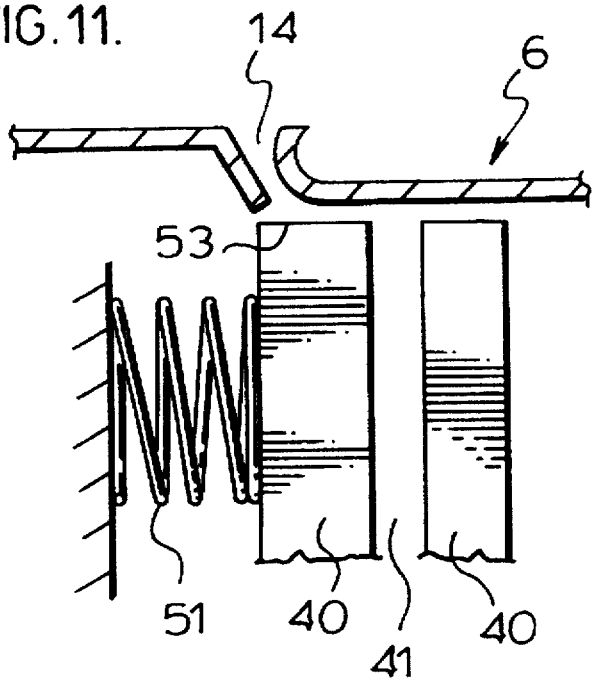

As generally shown in FIG. 10 and FIG. 11, the guide members 40 may be spring loaded by spring 51 to bias the guide members to a non-aligned position relative to the inlet 14 of the security box (FIG. 11). Insertion of the security box into the validator causes drive wheel 16*a* to contact idler wheel 17 secured to the guide members 40 (see FIG. 5) and move the guide members 40 to the aligned position of FIG. 4 and FIG. 10 with slot 41 aligned with inlet 14. Removal of the security box 40 from the validator 2 causes the guide members to move across and block the inlet 14. Face 53 of each guide member effectively restricts inlet 14 when the security box is removed. The spring loaded guide members also serve as the spring bias to maintain idler wheel 17 in contact with drive wheel 16*a*.

Although various preferred embodiments of the present invention have been described herein in detail, it will be appreciated by those skilled in the art, that variations may be made thereto without departing from the spirit of the invention or the scope of the appended claims.

The embodiment of the invention in which an exclusive property or privilege is claimed are defined as follows:

1. A currency validator which includes means for receiving bills and if validated stores said bills in a releasable security box secured to said validator, and wherein said security box is closed and includes a narrow slot sized to closely receive in the length of said slot the width of the bill as a bill is progressively longitudinally fed into said security box when validated, said security box being releasably retained in said currency validator by a first lock arrangement preventing unauthorised release of said security box from said validator and aligning said slot with a discharge position of a bill drive arrangement which causes a validated bill to pass through said slot and into the closed security box, and a second lock arrangement associated with a door access in a wall of said security box through which access to the interior said security box is gained, said second lock arrangement preventing unauthorised access to said security box independent of securement to said validator.

2. A currency validator as claimed in claim 1 wherein said second lock arrangement is not accessible when said security box is secured to said validator.

3. A currency validator as claimed in claim 1 wherein said security box includes interior thereto a guide arrangement for receiving bills which pass through said narrow slot and an actuator for forcing a received bill positioned in said guide arrangement to a bill stacker area to one side of said guide arrangement.

4. A currency validator as claimed in claim 3 wherein said actuator includes a drive transfer structure in a side of said security box and said validator includes a drive member positioned to cooperate with said drive transfer structure and cause said actuator to force a received bill into said bill stacker area when said drive member is activated.

5. A currency validator as claimed in claim 4 wherein said drive member is a rotating cam member.

6. A currency validator as claimed in claim 5 wherein said drive transfer structure is a cam member extending through a port in security box.

* * * * *